US005383684A

United States Patent [19]

Smath

[11] Patent Number: 5,383,684

[45] Date of Patent: Jan. 24, 1995

[54] BOOK

[76] Inventor: Jerome R. Smath, 29 Prospect Pl., Croton-on-Hudson, N.Y. 10520

[21] Appl. No.: 218,422

[22] Filed: Mar. 28, 1994

[51] Int. Cl.[6] ..... B42D 3/00

[52] U.S. Cl. ..... 281/29; 281/37; 281/21.1; 281/51; 446/147

[58] Field of Search ..... 281/29–31, 281/37–51, 21.1; 402/80 R, 70, 73; 446/147, 148, 149

[56] References Cited

U.S. PATENT DOCUMENTS

| | | | |
|---|---|---|---|
| 2,178,903 | 11/1939 | Cole | 446/147 X |
| 2,546,878 | 3/1951 | Townley | 446/148 |
| 4,120,100 | 10/1978 | Dugan | 446/147 X |
| 4,608,024 | 8/1986 | Skolnick | 446/148 |
| 4,909,542 | 3/1990 | Marks | 281/21.1 |

*Primary Examiner*—Willmon Fridie
*Attorney, Agent, or Firm*—Melvin I. Stoltz

[57] ABSTRACT

By providing a foldable portion in association with the cover of a book with the cover and foldable portion incorporating coordinated indicia thereon, a unique book construction is achieved which provides a readily deployable, enlarged, visually stimulating display associated therewith. Preferably, the foldable portion is mounted or cooperatingly associated with the lower or bottom edge of the cover and incorporates an integrally formed fold line therein. In this way, the cover in combination with the foldable portion establishes an elongated, substantially continuous overall configuration which enables the book to be vertically mounted on a supporting surface with the folded portion extending therefrom. In the preferred arrangement, the book is mounted on a support surface in an up-right, self-standing position, with the folded portion extending outwardly and downwardly from the book cover presenting the visual impression that the book and/or the indicia appearing thereon is physically sitting on the support surface.

12 Claims, 2 Drawing Sheets

BOOK

TECHNICAL FIELD

This invention relates to novelty book constructions and, more particularly, to novelty book constructions for children.

BACKGROUND ART

With the ever increasing need to develop childhood education and enhance children's reading and learning capabilities, numerous book constructions have been developed in an attempt to make reading fun and exciting while also being educational. In this regard, numerous prior art systems have been developed which contain brightly colored figures or characters, pop-up characters, or three-dimensional items throughout the book to entertain children. However, such prior art book systems are typically placed on a bookshelf after use in a manner which prevents the book from being visually distinctive. Consequently, the books are easily forgotten since they are out of visual contact with the child.

Other prior art systems have been manufactured of soft, pliable material or are three-dimensional in nature. These prior art book constructions become easily soiled and unattractive, thereby quickly losing their appeal to children. In addition, these soft, pliable prior art constructions or three-dimensional characters are not designed to sit on a bookshelf but, instead, are placed either in a toy box or other storage area out view of the child.

Therefore, it is a principal object of the present invention to provide a novelty book construction for children which is constructed for being placed on a bookshelf and provide an attractive, interesting, and visually stimulating display for a child.

Another object of the present invention is to provide a novelty book construction for placement upon a bookshelf and having the characteristic features described above which is continuously in view of a child, thereby encouraging the child to enhance their reading skills.

A further object of the present invention is to provide a novelty book construction for placement upon a bookshelf and having the characteristic features described above which provides further excitement and enjoyment for children for extended periods of time.

Another object of the present invention is to provide a novelty book construction for placement upon a bookshelf and having the characteristic features described above which can be taken by the child and easily replaced on the bookshelf in its same orientation without adult supervision.

Other and more specific objects will in part be obvious and will in part appear hereinafter.

SUMMARY OF THE INVENTION

By employing the present invention, all of the drawbacks and difficulties found in prior art systems are eliminated and a child-oriented book having enhanced value and interest is attained. In the book of the present invention, the book is preferably constructed with a cover thereof incorporating a foldout portion which enables the cover to achieve an enlarged, visually stimulating display.

Although the folded portion can be affixed to any portion of the cover, in the preferred embodiment, the novelty book of the present invention is constructed with the folded portion of the cover mounted or cooperatingly associated with the lower or bottom edge thereof. In this way, the cover in combination with the folded portion establishes an elongated, substantially continuous overall configuration which enables the book to be vertically mounted on a supporting shelf or table with the folded portion extending therefrom. In the preferred position, the book is mounted on a shelf or support in an up-right, self-standing position, with the folded portion extending outwardly and downwardly from the book cover presenting the visual impression that the book and/or the visual indicia on the cover is sitting on the bookshelf or support surface.

In order to visually enhance and excite the user of the book of the present invention, one of the characters, elements, or features contained in the book is visually displayed on the cover and folded portion. In this way, a visually stimulating, readily identifiable image appears on the cover and the folded portion in an integrated, cooperating, visually exciting manner.

In the preferred embodiment, the conventional cover zone visually depicts the head and upper body of the principal character featured in the book, while the foldable portion affixed to the lower end of the cover visually depicts, in the same general proportion, the remainder of the body of that figure. As a result, by constructing the folded portion with an integrally included fold line formed therein, the book of the present invention can be placed on a shelf, or other support surface, providing the visual appearance that a featured character detailed in the book is physically sitting on the edge of the shelf, or support surface, with the legs of the character extending downwardly from the shelf. As a result, a unique, visually exciting and highly interesting, self-contained character display system is integrally formed with the book, enabling an otherwise conventional book to be quickly and easily converted to an exciting, attractive and highly effective display which continuously generates a child's interest in the book.

By providing the novelty book of the present invention, a character, element, or feature contained in the book is represented on the cover in a visually exciting and stimulating manner, which enables the character, feature, or element to be displayed on, a shelf, table, desk or any other suitable support surface in a manner which will present the visual impression that the character, element, or feature is sitting on the shelf, table, desk, or other surface in full view of the child. In this way, substantially enhanced enjoyment, excitement and interest are provided to the child, as well as establishing continuous visual contact by the child with the visual image represented on the cover. In this way, excitement and enhanced interest in the book is provided, encouraging the child to pick up the book and re-read the story contained therein. In this way, the child's reading skills are strengthened and the usefulness of the book of the present invention is substantially enhanced.

If desired, the book of this invention can be constructed with the folded portion affixed to another area of the cover, such as its top edge or its side edge. Regardless of the location for affixing the folded portion to the cover, a substantially enhanced, visually exciting and interest-stimulating book construction is attained.

The invention accordingly comprises an article of manufacture possessing the features, properties, and relation of elements which will be exemplified in the article hereinafter described and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

By referring to FIGS. 1–4 along with the following detailed discussion, the construction and operation of preferred novelty book 20 of the present invention can best be understood. As is evident from this detailed disclosure, the present invention is capable of being constructed in a plurality of alternate embodiments without departing from the scope of this invention. In order to provide a complete disclosure, the preferred embodiment is fully detailed herein. However, this embodiment is provided for exemplary purposes only and is not intended to limit the scope of the present invention.

As fully depicted in FIG. 1–4, in its preferred embodiment, novelty book 20 comprises a front cover 21, a plurality of pages 22, and a back or rear cover 23. In order to visually enhance and excite a child's interest in book 20, front cover 21 incorporates visually stimulating indicia printed thereon. In the preferred embodiment, the visually stimulating indicia printed or otherwise appearing on front cover 21 presents and displays one of the principal characters featured in book 20.

Figure 2:
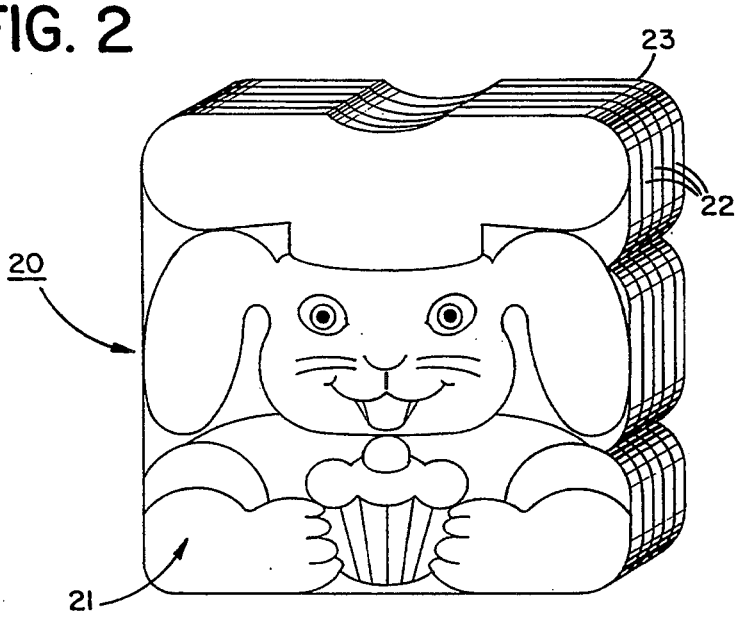
FIG. 2 is a perspective view of the novelty book construction of the present invention in its fully folded configuration.

If desired, book 20 can be arranged to appear in a generally conventional manner as depicted in FIG. 2. As shown therein, novelty book 20 can represent any conventional child-oriented book having a cover picturing a principal character contained in the book. However, by employing the teaching of the present invention, novelty book 20 can be quickly and easily converted into a unique, visually exciting, and stimulating display.

Figure 1:
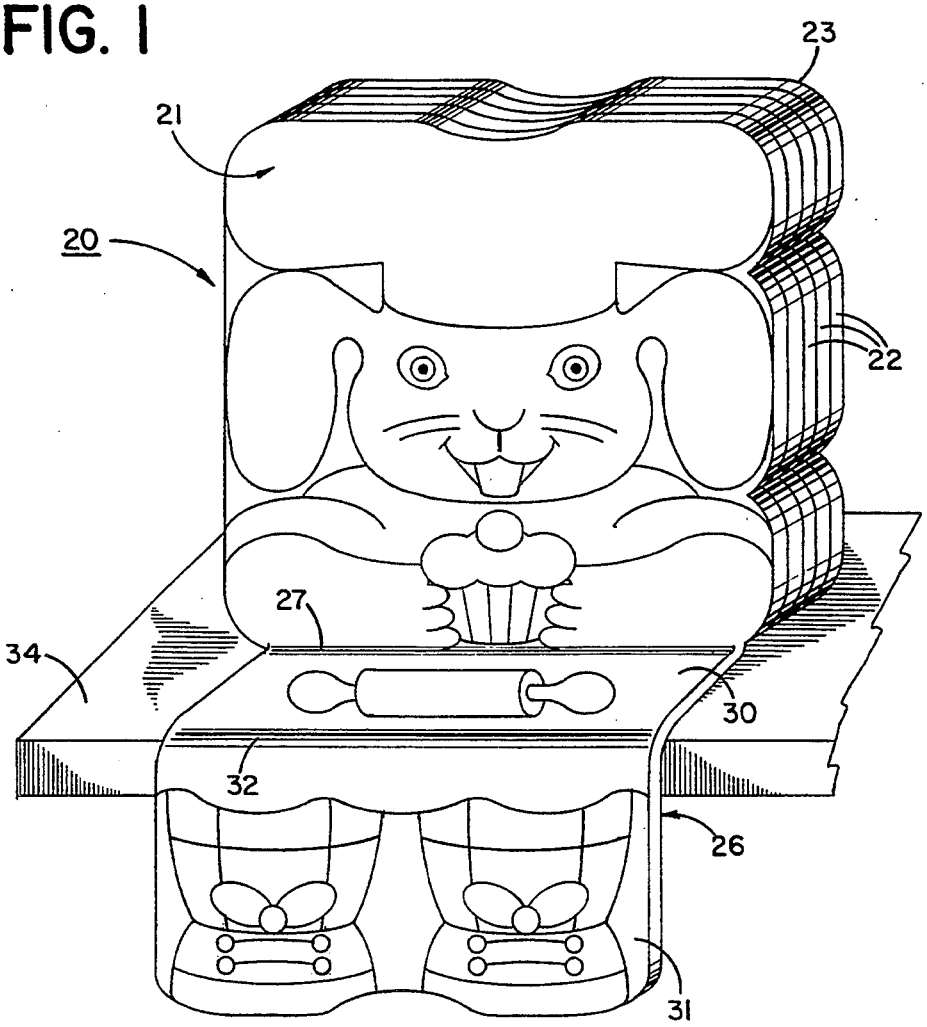
FIG. 1 is a perspective view of the novelty book construction of the present invention in its unfolded and displayed position.
Figure 3:
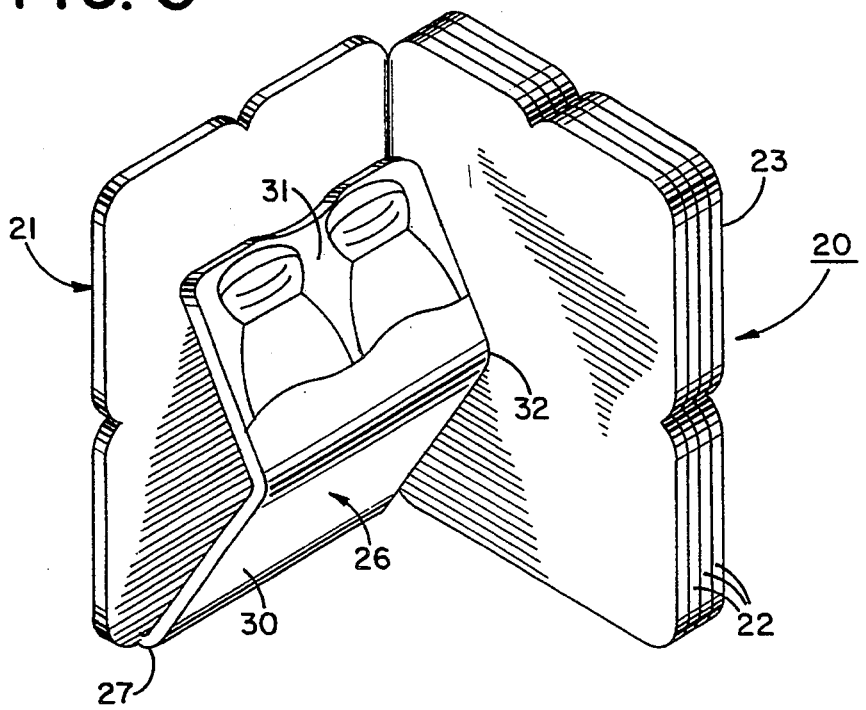
FIG. 3 is a perspective view depicting the book of FIG. 2 with the cover open for viewing the folded portion thereof.

As shown in FIG. 1, front cover 21 of novelty book 20 preferably comprises folded portion 26 which is integrally connected with front cover 21 preferably along a fold line 27 positioned at the bottom or lower edge of cover 21. In this way, folded portion 26 can be pivoted from a stowed position, as depicted in FIGS. 2 and 3, to a fully extended, viewable position, as best seen in FIG. 1.

In the preferred embodiment, folded portion 26 comprises two sections 30 and 31 which are separated by fold line 32. In addition, sections 30 and 31 each comprise indicia printed thereon which is constructed for visually cooperating with the visual display contained on front cover 21.

As discussed above, the preferred embodiment employs a character found in novelty book 20 as the visual indicia displayed on cover 21. In addition, sections 30 and 31 of folded portion 26 also comprise indicia representing the same character, with the indicia displayed on folded portion 26 comprising an additional, extended representation of the particular character.

By employing the present invention, as is readily apparent from FIG. 1, cover 21 preferably comprises the head and upper body of the character being depicted thereon, with folded portion 26 visually containing the remaining body portion and legs of the character represented on cover 21. In this way, by fully unfolding portion 26, an entire head-to-toe visual display of the desired character is obtained.

Preferably, the present invention is constructed with fold lines 27 and 32 formed in cover 21 and portion 26 in parallel relationship to each other, in order to enable the entire novelty book 20 of the present invention to be positioned in a unique, visually exciting displayed arrangement previously unobtainable with any prior art system. As shown in FIG. 1, whenever desired, novelty book 20 can be placed in a fully displayed position on shelf 34, or any other desired support surface, in a manner which visually depicts the featured character as sitting on shelf 34.

In this preferred display configuration, cover 21, pages 22 and rear cover 23 are placed on shelf 34 substantially perpendicularly therewith, with section 30 of folded portion 26 extending substantially perpendicularly from the bottom edge of cover 21 in a plane parallel to the top surface of shelf 34, effectively lying thereon. Section 31 extends substantially perpendicularly from section 30 along fold line 32, visually depicting the legs of the featured character in a manner which visually depicts the featured character appearing as if the character were physically sitting on shelf 34 with the legs of the character extending from shelf 34. In this way, a unique, exciting and visually stimulating display is attained, with novelty book 20 providing substantially enhanced interest and excitement to any child.

By employing the present invention, novelty book 20 can be placed on shelf 34, or any other support surface, in a manner which enables book 20 to be continuously, visually displayed to the child. In addition, novelty book 20 becomes more than a mere storybook to be read and put away. Instead, novelty book 20 of the present invention also becomes a toy or play item with which the child can relate, as a child would relate to any toy or stuffed animal. By employing the present invention, a featured character in novelty book 20 becomes more than a mere drawing on a page in a book and, instead, becomes a "life-like" character which is capable of physically sitting on a bookshelf or other support surface.

In addition to providing a substantially enhanced relationship and identification by the child with novelty book 20 and a featured character therein, the unique construction of novelty book 20 assures that novelty book 20 is continuously displayed in a manner which is readily visible by the child at any time. In addition to enjoying the book as a toy or play item, novelty book 20 is also likely to be taken by the child for re-reading substantially more frequently than any other book which is not in visual contact with the child.

As shown in FIG. 3, if continuous display of novelty book 20 is not desired, folded portion 26 is merely moved from its fully displayed position to its stowed position behind front cover 21. Once in a stowed position, cover 21 can be closed, with book 20 visually appearing as any conventional child book. This fully stowed and closed position is shown in FIG. 2.

Figure 4:
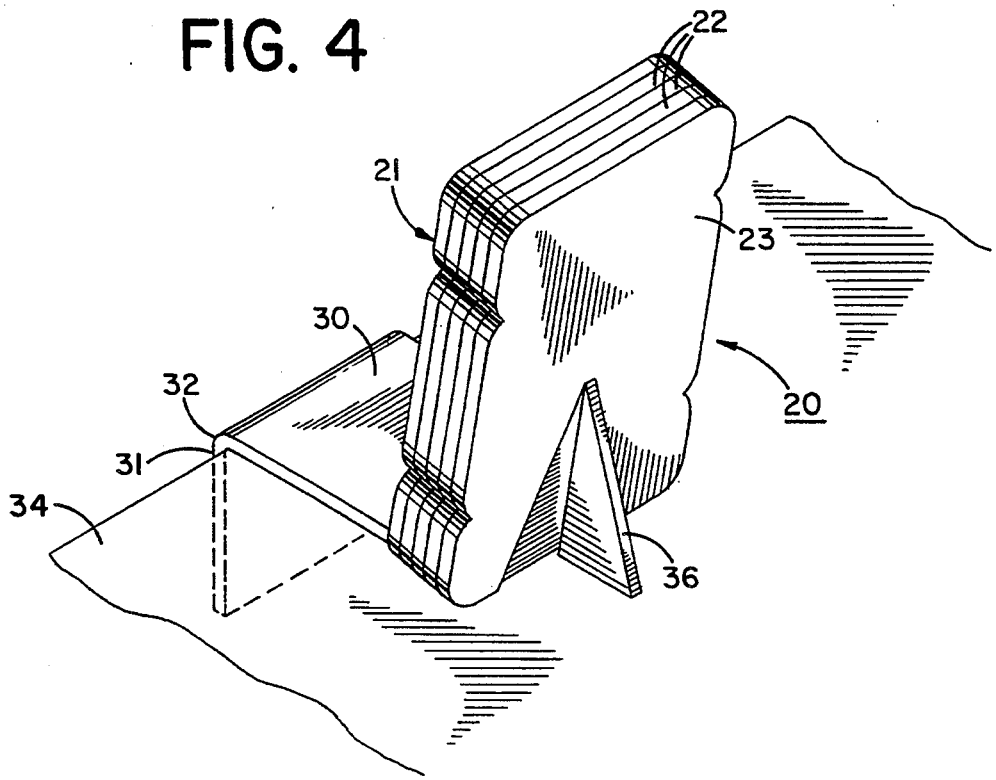
FIG. 4 is a perspective view, viewing the book construction of the present invention from the rear showing an optional support stand formed in the rear cover thereof.

If desired, rear cover may incorporate a pivotable support stand 36 formed therein in order to assist in assuring that novelty book 20 is maintained in its fully erect, displayed position, when so desired. As depicted in FIGURE 4, in this optional embodiment, rear cover 23 comprises a pivotable segment 36 which can be moved from a stowed position to an extended position, whereby support stand 36 is provided for assuring secure maintenance of novelty book 20 in its fully erect, perpendicularly arranged, mounting on shelf 34.

Depending upon the construction of novelty book 20 and the thicknesses employed for front cover 21 and rear cover 23, as well as pages 22, the use or incorporation of pivotable stand 36 may be unnecessary. However, the incorporation of pivotable portion 36 is preferred in order to assure that secure, continuous, trouble-free supported maintaining of novelty book 20 on shelf 34 in the desired fully erect manner is provided.

Although novelty book 20 has been depicted with folded portion 26 pivotably mounted to the lower or bottom edge of front cover 21, the concept of this invention can be employed by incorporating a pivotable, movable, or folded cooperative portion formed along any desired location on cover 21 or any alternate location, such as rear cover 23. For example, if desired, folded portion 36 can be mounted along the side edge or top edge of cover 21, without departing from the scope of this invention.

In particular, if folded portion 26 were formed along the free side edge of front cover 21, a featured character could be depicted in a generally seated position on cover 21 with the lower body and legs of the character extending outwardly from the side edge of cover 21, as fully depicted on folded portion 26. In this way, the concept of the present invention would be equally applicable, since novelty book 20 would be displayed on a shelf or support surface with the book erect on the particular surface in full visual contact with the child for providing the desired enhanced and visual stimulation attained by this invention. Similarly, the incorporation of a readily extendable, folded portion, cooperatively associated with a child-oriented book can be attained in a wide variety of alternate constructions, without departing from the scope of this invention.

It will thus be seen that the objects set forth above, among those made apparent from the preceding description, are efficiently attained and, since certain changes may be made in the above article, without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. A novelty book for providing enhanced interest and excitement, said novelty book comprising A. a first cover incorporating visually stimulating indicia appearing thereon;

B. a plurality of pages attached to the cover along one edge thereof; and

C. a movable portion a. pivotally mounted to the first cover along an integrally formed first fold line for pivotal movement relative thereto, b. incorporating visually stimulating indicia appearing thereon directed to the same subject as the indicia appearing on the cover, c. movable from a first stowed position to a second displayed position wherein said movable portion is directly associated with the cover to provide an enlarged visual display of a desired subject, and d. comprising two sections integrally connected to each other and incorporating a second fold line formed between said two sections, with said second fold line being parallel to the first fold line;

whereby a novelty book is attained which incorporates an enlarged, integrated display structure capable of being presented quickly and easily and maintained in a fully displayed configuration with ease for providing added interest and excitement to the book.

2. The novelty book defined in claim 1, wherein said movable portion is further defined as being mounted along the bottom edge of the first cover.

3. The novelty book defined in claim 2, wherein said first cover is further defined as comprising the front cover of the book.

4. The novelty book defined in claim 2, wherein said indicia appearing on the first cover and the movable portion is further defined as comprising one selected from the group consisting of a character, element, and feature contained in the book.

5. The novelty book defined in claim 4, wherein said indicia is further defined as comprising a visual representation of a principal character referred to in the book.

6. The novelty book defined in claim 5, wherein said indicia is further defined as visually representing the principal character depicted from head to toe, with the indicia appearing on the first cover representing the head and upper body portion of the character.

7. The novelty book defined in claim 6, wherein said movable portion is further defined as being constructed for cooperative visual integration with the first cover for enabling the book to be positioned on a supporting surface and provide the visual impression that the character depicted thereon is physically sitting on the supporting surface.

8. The novelty book defined in claim 1, wherein said book further comprises a second cover associated therewith.

9. The novelty book defined in claim 8, wherein said second cover comprises the rear cover and is further defined as incorporating a movable support portion formed therein for providing an easily employed support stand for maintaining the book in the fully displayed configuration whenever desired.

10. The novelty book defined in claim 6, wherein said movable portion is further defined as comprising indicia representing the lower body and legs of the character depicted thereon.

11. The novelty book defined in claim 10, wherein the lowermost section of the movable portion is further defined as comprising a visual representation of the legs below the knees of the character with the knee position of the leg being located substantially along the fold line formed therein, whereby the lowermost portion, when displayed on a support surface, provides the impression of a character sitting on the support surface with the legs, below the knees, extending therefrom.

12. The novelty book defined in claim 11, wherein the indicia appearing on the cover and movable portion are further defined as being in the same relative proportions, thereby representing a full display of the character when said movable portion is fully extended from the first cover.

* * * * *